United States Patent [19]

Grau

[11] 4,299,432

[45] Nov. 10, 1981

[54] LOCKING ELECTRICAL CONNECTOR APPARATUS

[75] Inventor: Thomas G. Grau, Morristown, N.J.

[73] Assignee: Bell Telephone Laboratories, Incorporated, Murray Hill, N.J.

[21] Appl. No.: 136,779

[22] Filed: Apr. 3, 1980

[51] Int. Cl.[3] ..... H01R 13/00

[52] U.S. Cl. ..... 339/75 M

[58] Field of Search ..... 339/74 R, 75 R, 75 M, 339/91 R

[56] References Cited

U.S. PATENT DOCUMENTS

| | | | |
|---|---|---|---|
| 1,169,314 | 1/1916 | Zannoth et al. | 339/74 R |
| 3,036,169 | 5/1962 | Kunlen et al. | 339/75 R |
| 3,828,300 | 8/1974 | Codrino | 339/74 R |
| 3,953,098 | 4/1976 | Avery et al. | 339/45 |
| 4,066,316 | 1/1978 | Rollings | 339/91 |
| 4,083,619 | 4/1978 | McCormick et al. | 339/75 |

*Primary Examiner*—Joseph H. McGlynn
*Attorney, Agent, or Firm*—William H. Kamstra

[57] ABSTRACT

A multipin backplane connector (10) featuring a locking mechanism for locking the connector to the pins. The terminal pins (11) are lengthened to extend beyond the connector pin receptacles (20) after the pins (11) are inserted therein and are further modified to provide a pair of opposing vertical notches (15) on the extensions of each. The locking mechanism comprises a rocker member (34) in the form of an obtuse "V", one section (37) having slots (38) dimensioned to fit freely about the pins (11), each slot (15) having opposing teeth (39) for engaging the pin notches (15). A pair of manually operated sleeves (46, 47) clasping opposite sides of the connector housing are moved over the two rocker member sections (37, 40) to raise and lower the slot teeth (39) out of and into engagement with the terminal pin notches (15).

9 Claims, 3 Drawing Figures

LOCKING ELECTRICAL CONNECTOR APPARATUS

TECHNICAL FIELD

This invention relates to electrical connector apparatus for connecting a plurality of cable conductors or other conducting elements to a corresponding plurality of terminal pins and more particularly to mechanisms and apparatus for locking such connector apparatus in place.

BACKGROUND OF THE INVENTION

Electrical interconnection between components and mounting frames in communications and electronic systems presently relies largely on individual wires assembled in cables for power distribution and signal transmission. In many systems, terminations from the circuit units are collected on a common backplane and appear as large fields of densely packed pins to which the conductors of interconnecting cables must be joined. A number of connector arrangements for accomplishing this interconnection function are known in the art. One such connector arrangement is described, for example, in U.S. Pat. No. 4,066,316 of R. W. Rollings issued Jan. 3, 1978. In the connector arrangement there disclosed, electrical connection between the connector terminals and the cable conductors is achieved by slicing through the conductor insulations by means of bifurcated blades extending from one end of the connector terminals, which blades at the same time seize the bared conductors to make the connections. The individual cable conductors are first sorted and arranged on a first insulated member mounting the conductors in a pattern corresponding to the spacings of terminal blades retained in a second insulated housing member. The two members are adapted to be engaged one by the other, during which engagement the blades function as described to make the electrical connections. After this assembly of the members, a unitary connector plug is realized which may then be manually positioned as required to receive backplane or other terminal pins.

It will be appreciated that in order to achieve reliable electrical connections, the connector assembly must be securely held by, and maintained in contact with the backplane pins to prevent any loosening of the connections as the result of manual inadvertent movement of the assembly, vibration, temperature changes, and the like. At the same time, the connector assembly must provide for ready separation from the backplane pins in order to permit wiring changes and maintenance should such attention prove necessary. In one prior art arrangement, the connector is latched in place by means of a mounting interposed between the connector and the backplane. The mounting is fitted over the backplane terminal pins and is secured to particular ones of the pins which are clasped in the mounting. These pins are unavailable for electrical connection. The connector is then latched in place by mounting bails snapped behind connector housing shoulders. Although such a latching arrangement has in the past proved satisfactory, it has the disadvantage of adding another, separate part to the connector assembly, and, further requires the availability of a specialized tool operating on the mounting bails to effect its release. It is accordingly the problem of integrating in one unitary structure an electrical connector and its latching mechanism to which the apparatus of this invention is chiefly directed. It is also an objective of this invention to provide a new and novel latching mechanism for multipin electrical connectors.

SUMMARY OF THE INVENTION

The aforementioned objectives are advantageously realized and a technical advance is achieved in accordance with the principles of this invention in a connector arrangement in which a plurality of two-bladed contact receptacles are typically adapted to receive a corresponding plurality of terminal pins extending from a backplane or other electrical apparatus. According to the invention, the pins are lengthened to extend somewhat beyond the connector portion housing the contact receptacles and each pin has formed therein near its end a pair of opposing vertical notches. The connector is also extended in order to provide an operating area for a latching mechanism for engaging the pin notches. The mechanism comprises a rocker member one section of which is slotted to receive the terminal pins, each of the slots having opposing teeth adapted to engage the pin notches in the latched position. The rocker member is maintained in the latter position by a pair of sleeves fitted about the connector housing proper and the slotted section of the rocker member. Extending from the slotted portion of the rocker member and at a slight angle upwardly therefrom is a lever section, the rocker member being pivotable about the lower juncture of the two sections to raise the slotted section from engagement with the terminal pins. This is accomplished by manually drawing the sleeves along the connector housing by means of a handle provided therefor. As a result, the sleeves force the lever section downward thereby raising the slotted section out of pin engagement. The connector is then readily withdrawn from the terminal pins.

BRIEF DESCRIPTION OF THE DRAWING

The features and advantages of a connector arrangement according to this invention will be better understood from a consideration of the detailed description of the organization and operation of one illustrative embodiment thereof when taken in conjunction with the accompanying drawings in which.

and

Figure 2:
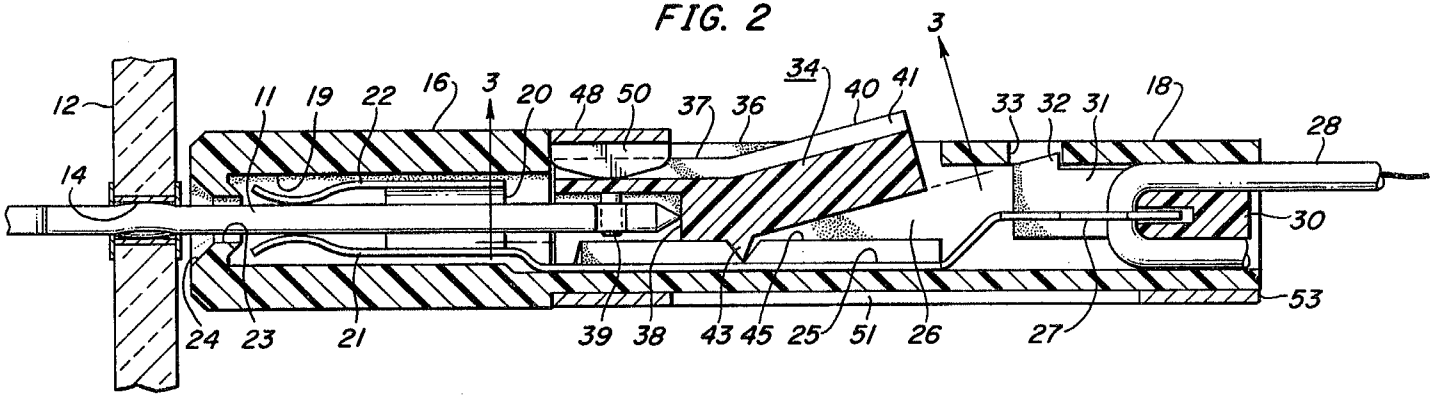
FIG. 2 is a sectional view of the connector arrangment of FIG. 1 showing its internal details after its mounting in place about the backplane terminal pins, the latching mechanism being shown in its operated state.
Figure 3:
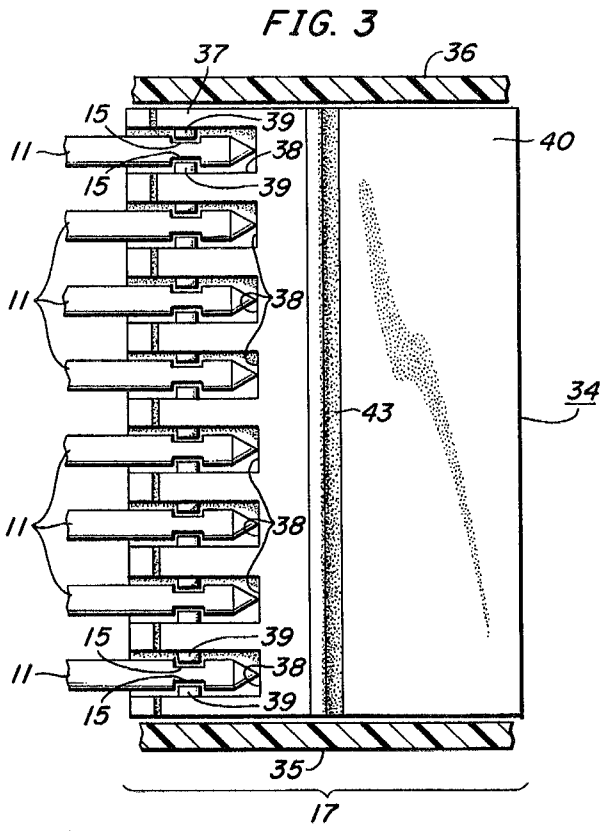

FIG. 3 is a sectional view of the connector latching mechanism of FIG. 2 taken along line 3—3.

DETAILED DESCRIPTION

Figure 1:
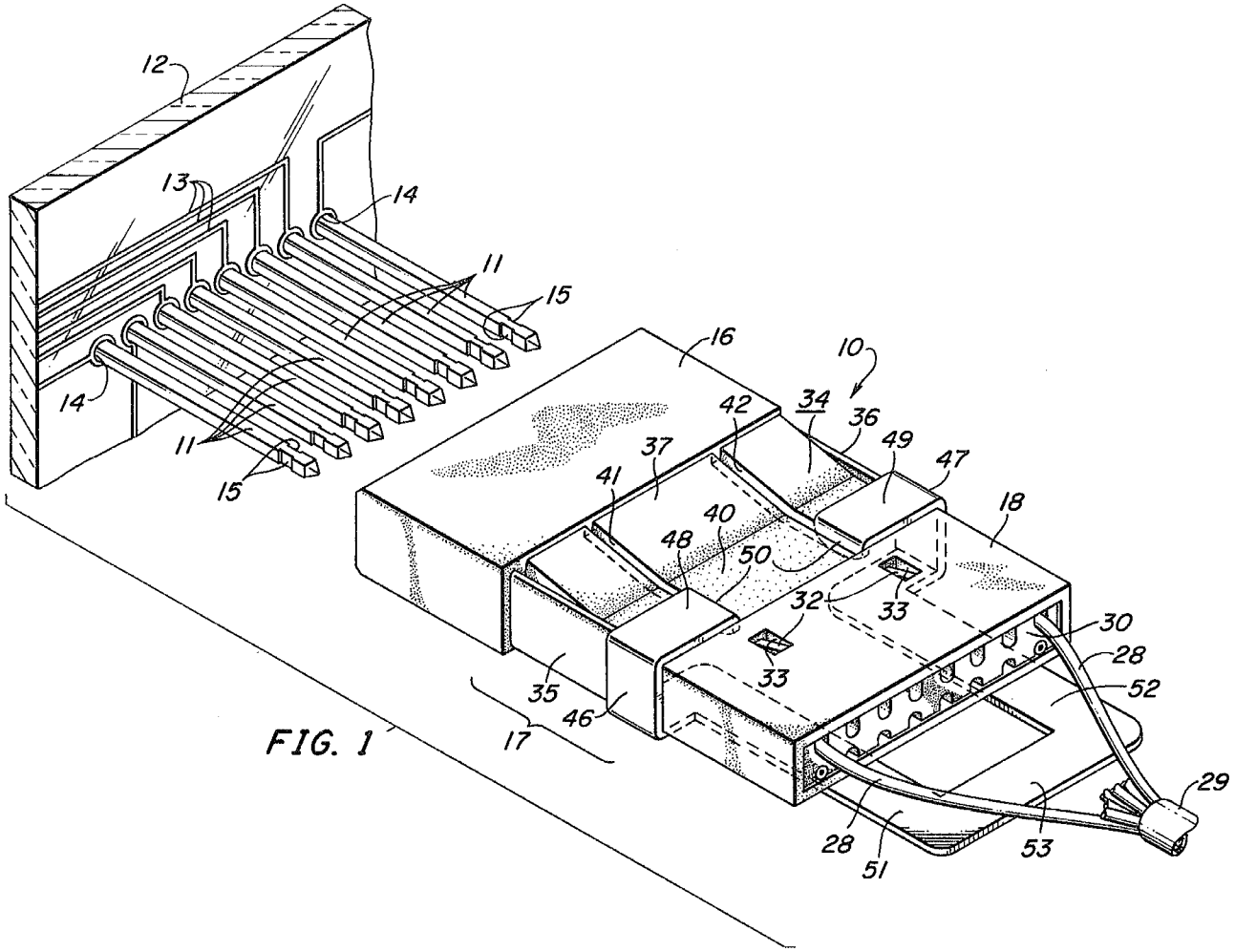
FIG. 1 is a perspective view of an illustrative backplane terminal pin field and a connector arrangement according to the invention, showing the latter in position before the insertion of the pins.

A multiconductor connector arrangement 10 according to this invention is shown in FIG. 1 positioned in alignment with the terminal pins 11 of a typical backplane, a portion 12 of which is shown. The backplane may conventionally have printed wiring 13 mounted thereon which interconnects via holes 14 into which pins 11 are inserted. The pins 11 may be of substantially square cross section and, in accordance with the invention, each has formed thereon on opposite sides and near its end, a pair of rectangular notches 15 vertically aligned as viewed in the figure. The connector 10 comprises a pin receptacle housing 16, a locking section 17, and, in the specific embodiment being described, a conductor contact housing 18. Housing 16 and its enclosed contacting elements (see FIG. 2) may comprise structure similar to that described in the aforementioned patent of Rollings. Thus, rectangular housing 16 has mounted within an internal cavity 19 a plurality of terminal pin receptacles 20 aligned to correspond to the row of backplane terminal pins 11. The latter pins are received by the receptacles 20 between pairs of contact blades 21 and 22 via apertures and capture cones 24 presented in housing 16. Receptacles 20 are electrically extended to the conductor contact housing 18 by conductive strips 25 lying on the floor of locking section 17 which section presents an open topped cavity 26 between housing 16 and 18.

Strips 25 extend into the latter housing to terminate, after an alignment offset, in bifurcated blades 27 adapted to pierce conductor insulation to effect electrical contact. Such a conductor contact mechanism is well known and is described in detail, for example, in the forementioned Rollings patent. As shown in FIG. 1 and 2, in such an arrangement, the conductors 28 of a cable 29, representative ones of which are shown in FIG. 1, are sorted between the fingers of a comb plug 30 which plug is then inserted into housing 18 to force the conductors between the bifurcated blades to make the connections. Plug 30 may be maintained in place by latching fingers 31 having detents 32 each adapted to engage one wall of slots 33 provided in the upper wall of housing 18.

The locking mechanism according to this invention is shown in its locked position in locking section 17 in the fully assembled and mounted view of FIG. 2 and is shown in its unlocked position in the view of FIG. 1. The mechanism comprises a rocker member 34 slidably fitted in cavity 26 between a pair of side walls 35 and 36 (see also the underside view of FIG. 3). Member 34 is formed to present a slotted portion 37 having a plurality of slots 38 in its underside corresponding in number to, and dimensioned to freely admit, the backplane terminal pins 11. Extending from the opposite side walls of each of slots 38 is a pair of teeth 39 dimensioned to engage notches 15 of terminal pins 11 as so shown in FIG. 2 and 3. Rocker member 34 is further formed to present a lever portion 40 extending at a slight upward angle from slotted portion 37, the upper surfaces of both portions having a pair of continuing parallel slots 41 and 42 formed transversely therein. At the juncture of portions 37 and 40 on the underside of rocker member 34 a triangular ridge 43 is provided to ride in a corresponding triangular groove 44 formed in an insulative cover 45 of the contact strips 25 in cavity 26. The angle of groove 44 is somewhat more obtuse than the angle of ridge 43 in order to permit the angular movement of rocker member 34 from a position in which the underside surface of portion 37 rests on the flat surface of cover 45 to a position in which the underside surface of portion 40 rests on the surface of cover 45.

Rocker member 34 is shown in the latter position in FIG. 1, the slotted portion 37, as a result, being raised to permit the full insertion of backplane terminal pins 11 without interference from slot teeth 39. Rocker member 34 is firmly maintained in this position by a pair of sleeves 46 and 47 slidably clasping opposite sides of connector locking section 17. Upper flanges 48 and 49 of sleeves 46 and 47 ride on the upper edges of side walls 35 and 36, respectively, and each terminates at one end in a rounded lip 50 riding in the slots 41 and 42. Lower flanges of sleeves 46 and 47 at the underside of the connector extend outwardly from respective legs 51 and 52 of a "U" shaped handle 53, the base of which handle lies across the end of housing 18 for manual access. Handle 53 is conveniently of a flat cross section, the upper surface being maintained in slidable contact with the lower surface of the connector which surface may be recessed to receive handle 53 to reduce the connector side elevation.

After the connector has been fully joined with terminal pins 11, handle 53 is manually urged inward thereby moving sleeves 46 and 47 toward the housing 16 end of connector 10. As sleeves 46 and 47 are so moved, lips 50 riding in grooves 41 and 42 force slotted portion 37 of rocker member 34 downward thereby in turn causing the engagement of slot teeth 39 with notches 15 of terminal pins 11. This final position of sleeves 46 and 47 and rocker member 34 is shown in FIG. 2 from which figure it will also be appreciated that the angle between portions 37 and 40 of member 34 is determined to permit sufficient rotation of the latter member to clear notches 15 for releasing the connector. The latter operation is accomplished by withdrawing handle 53 which in turn causes sleeves 46 and 47 to tilt rocker member 34 to its release position. In this position, slot teeth 39 are out of engagement with pin notches 15 and connector 10 may be freely withdrawn from pins 11.

In the foregoing description, materials for the various elements of the connector arrangement according to the invention are not specified. It will be appreciated by one skilled in the art that suitable conductive and insulative materials will be employed where necessary in view of the functions performed by the elements. The connector housings and rocker members, for example, may be of a molded plastic material. It will further be appreciated that, although the specific connector arrangement described is designed to connect to a single tier of backplane terminal pins, a double tier connector analogous to the connector described in the aforementioned Rollings patent may readily be achieved within the concept of the invention. Thus, as may be envisioned by reference to FIG. 2, by adding a mirror-image structure to that there shown, a two-tier pin connector is realized, the operation of two pairs of operating sleeves being controlled by a single handle 53. The specific illustrative connector described in the foregoing also contemplated the ultimate connection of the backplane pins to individual conductors of a cable. It will be appreciated that the scope of the invention extends to arrangements in which electrical connections are made to ribbon cable other than cable conductors. Connector 10 could, for example, provide for printed wiring or other non-flexible conductor terminations.

Accordingly, it will be understood that what has been described is considered to be only one specific illustrative connector arrangement according to the principles of the invention and various and numerous other arrangements may be devised by one skilled in the art without departing from the spirit and scope of the invention as limited only as defined in the accompanying claims.

What is claimed is:

1. Electrical connector apparatus comprising a plurality of terminal pins (11) and a connector (10) having a plurality of receptacles (20) mounted in a housing (16) for receiving respectively said plurality of terminal pins (11) characterized in that said connector (10) has a cavity (26) formed therein having opposite side walls (35, 36) and having an opening on a face of said connector (10), each of said pins (11) extends into said cavity (26) and has a pair of opposing notches (15) formed at the end in said cavity (26) and in a locking mechanism comprising a rocker member (34) disposed in said cavity (26), said member (34) having a first and a second section (37, 40), said first and second sections extending at an angle with each other toward said opening, said first section (37) having a plurality of slots (38) formed therein to correspond respectively with said plurality of terminal pins (11), side walls of each of said slots (38) having opposing teeth (39) adapted to engage said notches (38) and sleeve means (46) slidably operable on the surfaces of said sections (37, 40) of said rocker member (34) facing said opening for pivoting said last-mentioned member and thereby said teeth (39) into and out of engagement with said terminal pin notches (38).

2. Electrical connector apparatus as claimed in claim 1 further characterized in that said sleeve means (46) comprises a substantially "U" shaped member having a flange (48) extending inwardly from a side wall (35) of said cavity (26) over said surfaces of said sections (37, 40).

3. Electrical connector apparatus as claimed in claim 2 further characterized in that said surfaces of said sections (37, 40) have a groove (41) formed therein parallel with said side wall (35) and in that said flange (48) has a lip (50) formed thereon downwardly extending in said groove (41).

4. Electrical connector apparatus as claimed in claim 2 or 3 further characterized in that said sleeve means (46) also comprises a handle (53) for manually operating said sleeve means (46).

5. Electrical connector apparatus as claimed in claim 1 further characterized in that said sleeve means (46) comprises a pair of substantially "U" shaped member (46, 47) inwardly directed over said opposite side walls (35, 36) of said cavity (26) and a handle (53) affixed to said members (46, 47) for simultaneously operating said members (46, 47).

6. Electrical connector apparatus as claimed in claim 5 further characterized in that said surfaces of said sections (37, 40) have a pair of grooves (41, 42) formed therein parallel with said side walls (35) and in that said members (46, 47) have lips (50) formed thereon downwardly extending in said grooves (41, 42).

7. Electrical connector apparatus for connecting to a row of electrical terminal plus pins (11) each having a pair of opposing notches (15) formed at an end thereof comprising a connector (10) having a row of receptacles (20) mounted in a housing (16) for receiving respectively said row of terminal pins (11) characterized in that said connector (10) has a cavity (26) formed therein having opposite side walls (35, 36) and having an opening on a face of said connector (10) and in a locking mechanism comprising a rocker member (34) disposed in said cavity (26), said member (34) being formed in an obtuse "V" having leg sections (37, 40) generally facing said opening, one of said sections (37) having a plurality of slots (38) formed therein to correspond respectively with said plurality of terminal pins (11), side walls of each of said slots (38) having opposing teeth (39) dimensioned to engage said notches (38) and means for rocking said rocker member (34) at the apex of said leg sections (37, 40) to thereby move said teeth (39) into and out of engagement with said notches (38) comprising sleeve means (46, 47) slidably operable on the surfaces of said leg sections (37, 40) in a plane substantially parallel with the axis of said terminal pin receptacles (20).

8. Electrical connector apparatus as claimed in claim 7 further characterized in that said surfaces of said leg sections (37, 40) have a pair of grooves (41, 42) formed therein parallel with said side walls (35) and in that said sleeve means (46) comprises a pair of substantially "U" shaped members (46, 47) inwardly directed over said opposing side walls (35, 36) of said cavity (26) and having flanges (48, 49) extending over said surfaces, each of said flanges (48, 49) having a lip (50) extending downwardly into one of said grooves (41, 42).

9. Electrical connector apparatus as claimed in claim 8 further characterized in that a handle (53) is affixed to said sleeve means (46) for simultaneously moving said members (46, 47) and said lips (50) in said grooves (41, 42).

* * * * *

UNITED STATES PATENT AND TRADEMARK OFFICE

CERTIFICATE OF CORRECTION

PATENT NO. : 4,299,432

DATED : November 10, 1981

INVENTOR(S) : Thomas G. Grau

It is certified that error appears in the above-identified patent and that said Letters Patent are hereby corrected as shown below:

In the claims, Column 5, claim 5, line 41, "member" should read --members--.

Signed and Sealed this

*Second* Day of *November 1982*

[SEAL]

*Attest:*

GERALD J. MOSSINGHOFF

*Attesting Officer*

*Commissioner of Patents and Trademarks*